US005186702A

United States Patent [19]

Amanze

[11] Patent Number: 5,186,702

[45] Date of Patent: Feb. 16, 1993

[54] MULTI-PURPOSE SIT-UP DEVICE

[76] Inventor: Charles U. Amanze, 14816 DaCosta, Detroit, Mich. 48223-1829

[21] Appl. No.: 779,726

[22] Filed: Oct. 22, 1991

[51] Int. Cl.[5] ..... A63B 26/00

[52] U.S. Cl. ..... 482/145; 482/140; 482/143

[58] Field of Search ..... 482/117, 140, 904, 145; 482/39, 40, 42, 143, 41; 602/33; 606/241

[56] References Cited

U.S. PATENT DOCUMENTS

| | | | |
|---|---|---|---|
| 4,185,816 | 1/1980 | Bernstein | 482/140 |
| 4,468,022 | 8/1984 | Wu | 482/140 |
| 4,494,750 | 1/1985 | Smith | 482/142 |
| 4,550,907 | 11/1985 | Melillo | 482/140 |

*Primary Examiner*—Richard J. Apley

*Assistant Examiner*—Jerome Donnelly

[57] ABSTRACT

A sit-up device having substantially the capability to support all types of sit-up exercises is disclosed. The device comprises a mounting base generally for the purpose of securing it to a fixture during use. Another aspect of the device is the adjustable section used to control the horizontal and vertical position of the feet restraining bar. When installed for use, the feet restraining bar remains parallel with the floor. The adjustability is produced by sliding motions between a lever and a base member which allows for greater vertical and horizontal adjustments. Hence the device can support all types of sit-up exercises postures. The mounting base of this device can be secured to any flat surface such as a door structure, house-hold and office furniture, smooth concrete, wood or metallic surfaces.

4 Claims, 4 Drawing Sheets

MULTI-PURPOSE SIT-UP DEVICE

BACKGROUND OF THE INVENTION

FIELD OF THE INVENTION

The present invention relates generally to an improved sit-up exercise device. More particularly, the present invention relates to a sit-up exercise device that can support all types of sit-up positions.

BACKGROUND OF THE ART

The essential reasons for performing the sit-up exercise is to strengthen the abdominal muscles and also maintain them in good physical condition. There are essentially three types of sit-up postures: the flat-leg, the limited-bent-knee and the full-bent-knee. In the flat-leg sit-up position, the exerciser's legs are flat on the floor and his/or soles make an angle of 90 degrees with the floor. With the limited-bent-knee stance, the knees of the exerciser are bent while seated on the floor and the soles maintain an acute angle with the floor. The third and most encouraged position for a sit-up exercise is the full-bent-knee posture. In this stance, the soles are held firmly and flat to the floor while the legs are bent at the knee.

Various proposals for sit-up devices have been disclosed such as those structures shown in U.S. Pat. No. 4,185,816, 4,653,747, 4,468,022 and 4,809,971. While the devices shown in these inventions can assist a sit-up exerciser, they are generally designed for one or two particular types of sit-up posture and cannot be adapted to accommodate all types of sit-up stances. Moreover, attachment to the door is the most preferred means of securing their devices before they can be used. U.S. Pat. No. 4,509,748 can only support the full-bent-knee posture for sit-up.

Exercisers choose their types of sit-up positions based on individual physical desires and abilities. It would therefore be highly desirable to provide one sit-up device that could adjust to properly support all types of sit-up positions.

DISCLOSURE OF THE INVENTION

It is therefore an object of the instant invention to provide an improved sit-up device having a mounting base and an adjustable section, that can assist a sit-up exerciser exercising alone, to perform the sit-up exercise in all types of sit-up postures.

Further, it is the object of the instant invention to provide a sit-up device that can assist a sit-up exerciser to strengthen their abdominal muscles and also maintain them in good physical conditions.

It is even further the object of the instant invention to provide a sit-up device that can be secured to a door, a metallic and non-metallic structure.

It is another object of the instant invention to provide a sit-up device that is light weight, easily mounted, dismantled and transportable.

It is yet another object of the instant invention to provide a sit-up device whose adjustable section can be easily transferable to more than one type of mounting base.

It is yet one other object of the instant invention to provide a sit-up device that can assist a sit-up exerciser of any age, height and/or feet size.

Details of the sit-up device with the mounting base and adjustable section and further objects and advantages thereof will become evident as the description proceeds and from an examination of the accompanying four sheets of drawings.

BRIEF DESCRIPTION OF THE DRAWINGS

The drawings illustrate a preferred embodiment of the invention with similar numericals referring to similar parts throughout the several views, wherein.

DETAILED DESCRIPTION OF THE PREFERRED EMBODIMENTS

Figure 1:
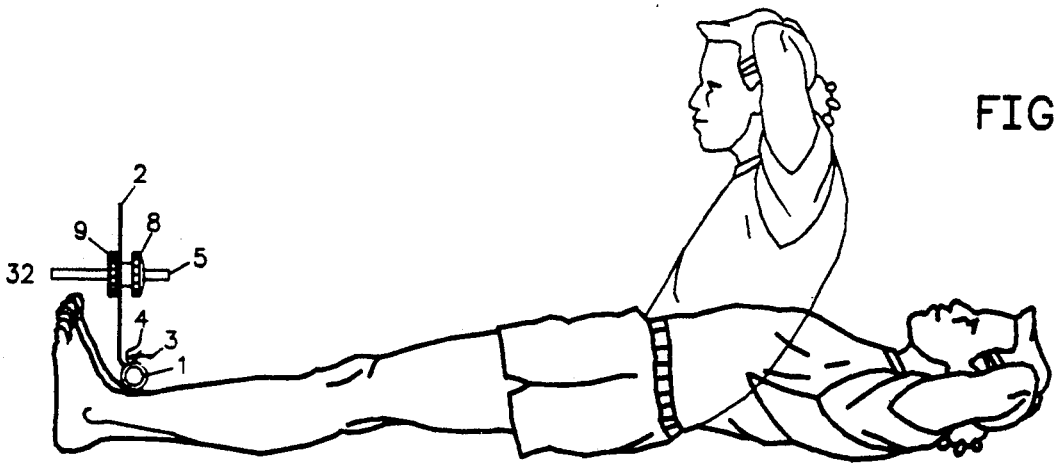
FIG. 1 is a side view illustrating the adjustable section of the subject invention aiding an exerciser performing the sit-up exercise while in the flat-leg position.
Figure 2:
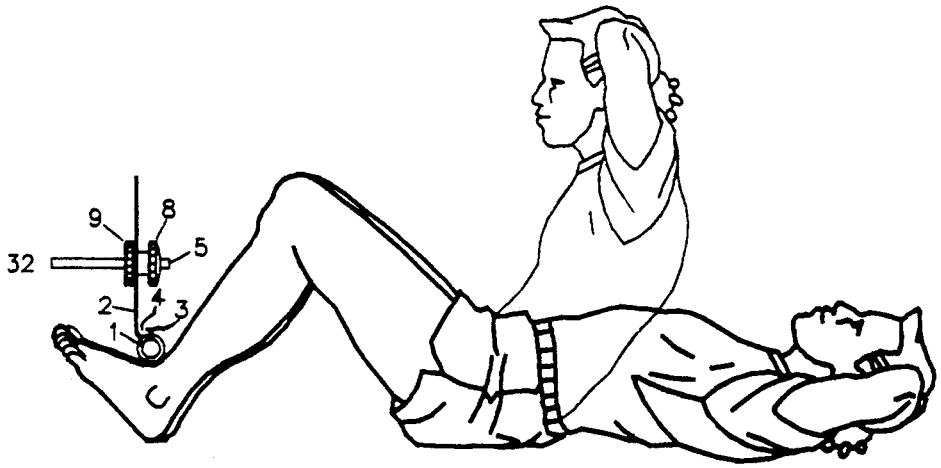
FIG. 2 is a side view illustrating the adjustable section of the subject invention being used by an exerciser to perform the sit-up exercise while in the limited-bent-knee posture.
Figure 3:
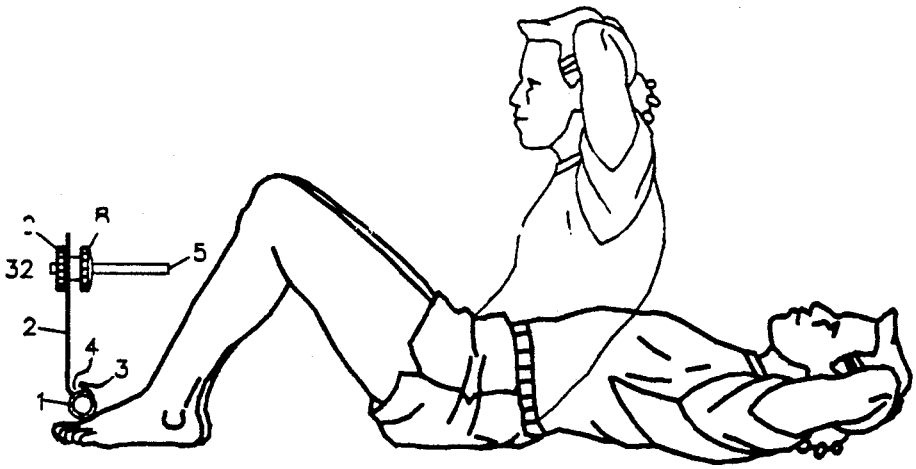
FIG. 3 shows a side view illustration of the adjustable section of the subject invention supporting a full-bent-knee sit-up exerciser.

In FIGS. 1 through 6, the feet restraining bar 1 is shown attached to the slotted lever 2 by means of knob 3. The assembly is attached to the adjustable section 32. A pair of soft rubber or foam gloves 4 forms a sleeve on bar 1. The foam 4 serves as cushion on the feet of the exerciser. Lever 2 and bar 1 are preferably produced separately to occupy minimum storage space after use.

Figure 5:
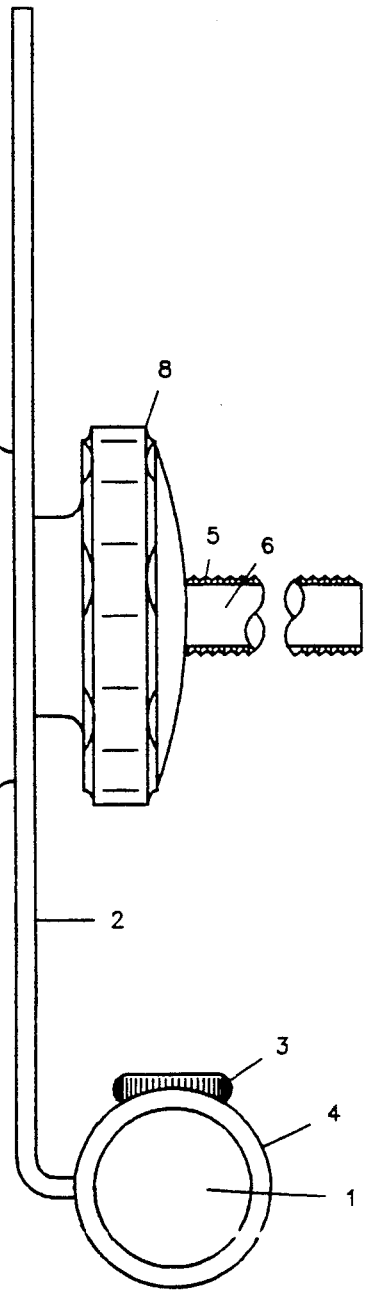
FIG. 5 is a side view of FIG. 4.

As best shown in FIG. 5, the adjustable section 32 consists of a threaded rod 5, a knob set 8 and 9, washer 11 and screw 14. The adjustable section 32 can be assembled in a wide variety of ways to achieve a large spectrum of horizontal and vertical adjustments for all types of sit-up postures.

Figure 6:
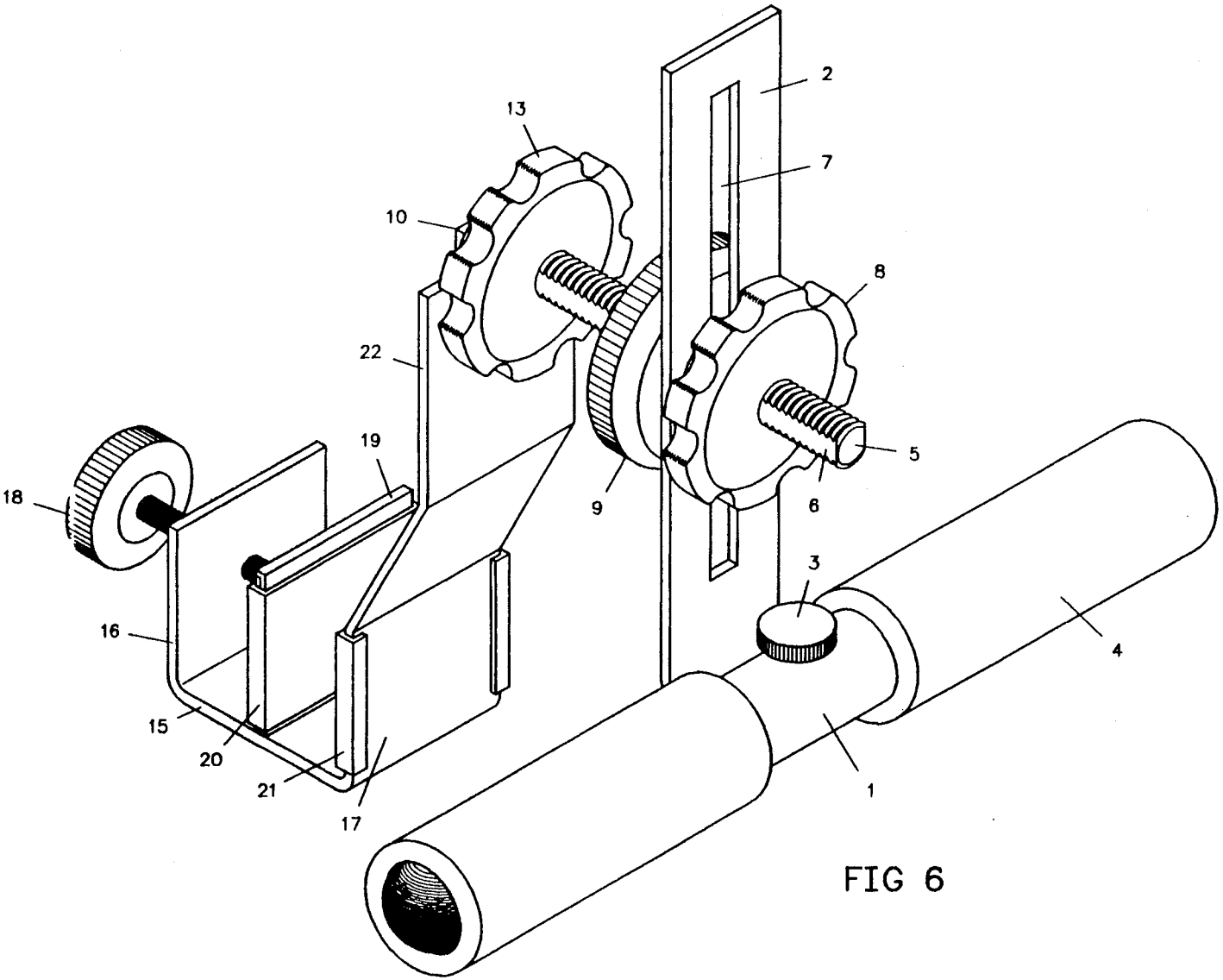
FIG. 6 is a perspective view of the subject invention with a mounting base attachable to a structure such as door.

Threaded rod 5 of the adjustable section 32 shown in FIGS. 5 and 6 is milled on its opposite sides 6 along its length. As further illustrated in FIG. 6, the slot 7 of lever 2 is designed to engage into the milled sides 6 of threaded rod 5. The engagement ensures that lever 2 remains perpendicular with the floor during and after all adjustments and also during use. Lever 2 is secured firmly on both sides along the axis of threaded rod 5 by knob set 8 and 9. Knob set 8 and 9 also control both vertical and horizontal adjustments of the feet restraining bar 1.

One end of the threaded rod 5 is shaped in the form of a square 34 to fit into receptacle 10 on the mounting plate 22. Screw 14 secures washer 11 to the square shaped end 34 of threaded rod 5. Washer 11, in conjunction with lock knob 13 holds the threaded rod 5 onto the mounting plate 22. Further, the assembly ensures that lever 2 is perpendicular with the floor, also, the feet restraining bar is parallel with the floor after installation and during use.

Illustrated in FIG. 6 is the subject invention made of structures adopted to be secured to a door or other fixtures. Bracket member 15 has two opposite bracket side walls 16 and 17 and preferably constructed by cold pressing. Clamping knob 18 is operatively connected to bracket side wall 16 and extends further to clamping plate 19. When clamping knob 18 is operated, clamping plate 19 moves as a result. A clockwise operation of clamping knob 18 butts clamping plate 19 towards bracket side wall 17. A structure (not shown), placed between clamping plate 19 and bracket side wall 17 serves as a means to secure the sit-up device.

Two resilient pads 20 and 21 are fitted into clamping plate 19 and bracket side wall 17 respectively to prevent the door from being marred. Bracket side wall 17 further extends to mounting plate 22 and constructed in the form shown in FIG. 6.

Figure 8:
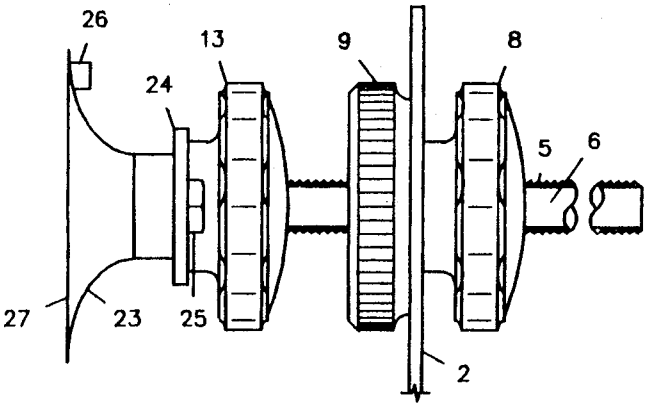
FIG. 8 is the side view of FIG. 7 with the adjustable section installed.
Figure 7:
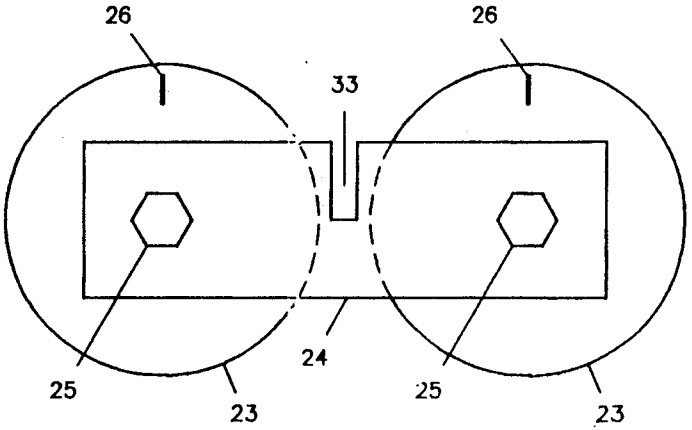
FIG. 7 shows a front view illustration of the mounting base of the subject invention made of two suction cups.
Figure 9:
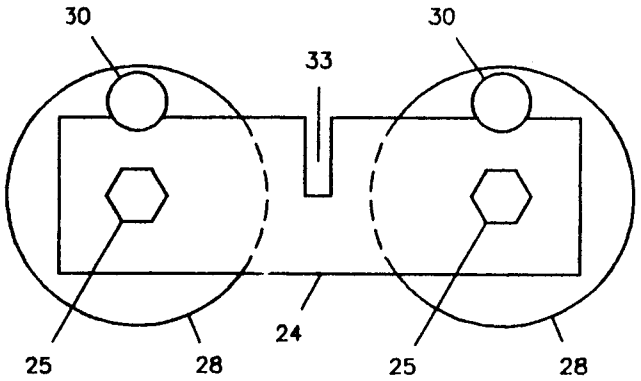
FIG. 9 shows a front view of the subject invention illustrating the mounting base made of two permanent magnets.

A base made of suction cup 23 that can be used to secure the subject invention onto a flat surface has mounting plate 24 attached to it by means of two bolts 25 and shown in FIGS. 7 and 8. Mounting plate 24 has slot 33 which engages end 34 of rod 5. The operational means to attach the suction cup to a flat surface is by lifting tip 26 and slightly depressing the suction cup 23 to the flat surface (not shown). In the process, air is evacuated from the chamber 27 between suction cup 23 and the flat surface, and the ensuing vacuum creates a bond between the cup 23 and the flat surface. A slight pull of tip 26 destroys the vacuum in chamber 27, and the device can be easily dismantled and stored.

Figure 4:
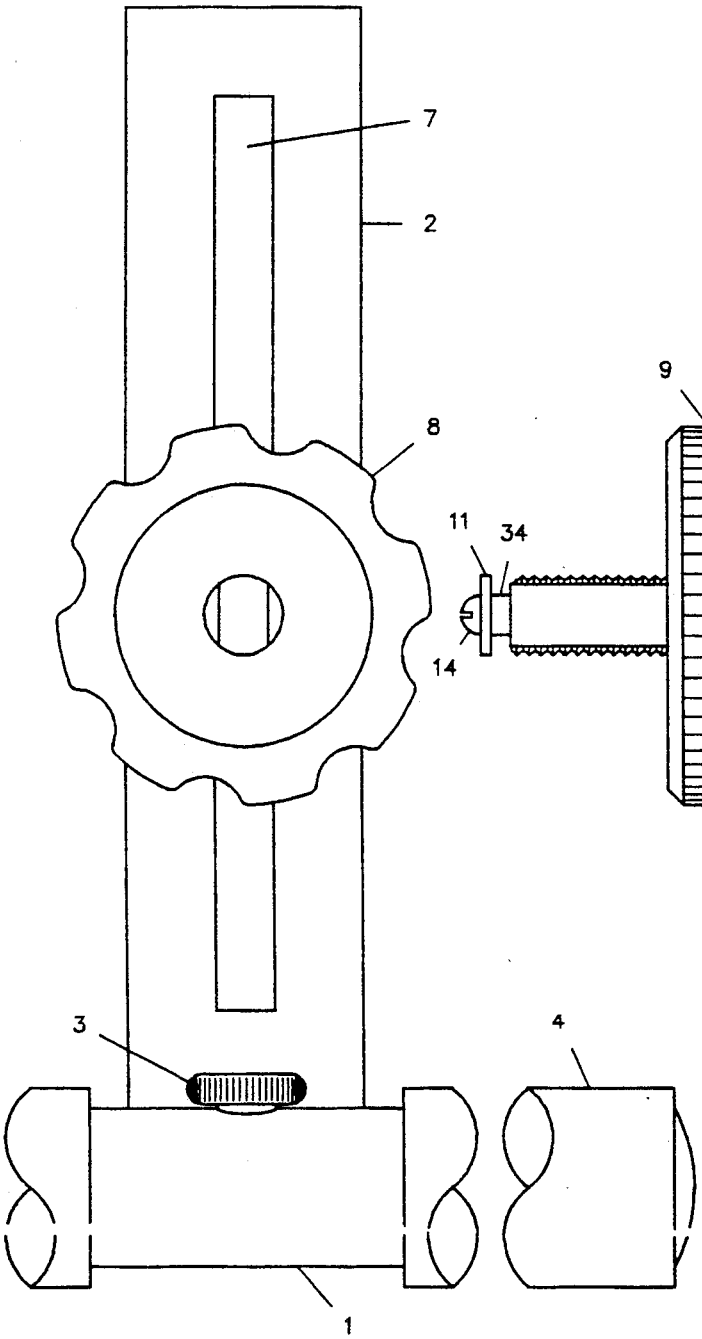
FIG. 4 shows a front view of the adjustable lever and feet restraining bar of the subject invention.
Figure 10:
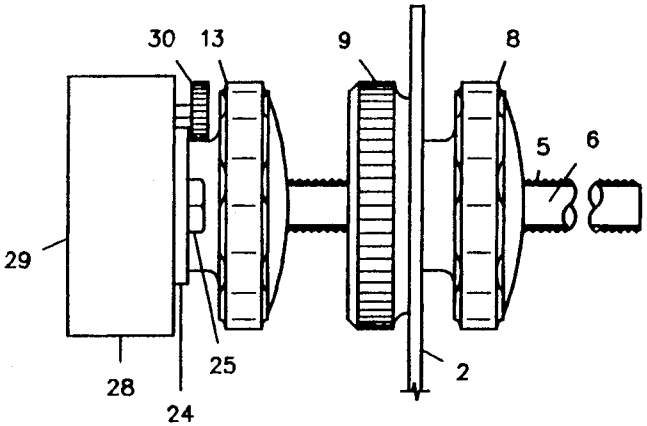
FIG. 10 is a side view of FIG. 9 with the adjustable section installed.

In FIG. 10, the adjustable section 32 of the subject invention displayed in FIG. 4 and 5 is shown mounted to a metallic structure (not shown) with two permanent magnets 28. The sit-up device can be mounted to the metallic structure by placing the cross section 29 of the magnet 28 directly unto the structure. A piece of cloth or soft material (not shown) may be placed between the cross section 29 of the magnet 28 and the metallic structure to prevent the structure from being scratched. The amount of force required to disengage the permanent magnet from the metal structure after use is reduced considerably by operating separator knob 30 in a clockwise rotation. While operating separator knob 30, cross section 29 of magnet 28 is raised from the metallic structure, thus allowing the magnetic base 28 to disengage easily.

In the drawings and specification, there is set forth a preferred embodiment of the invention and although specific terms are employed, these are used in a generic and descriptive sense only and not for purposes of limitation. Changes in any form and proportion of parts as well as the substitution of equivalents are contemplated as circumstances that may suggest or render expedient without departing from the spirit or scope of the invention as defined in the following claims.

What I claim is:

1. A sit-up exercise apparatus characterized by:

a bar for restraining feet of a person;

a lever element having a slot, one end of said lever being attached to a center portion of said bar;

a base slideably and adjustably connected to said lever element;

a means for slideably adjusting the lever element and bar in both vertical and horizontal directions with respect to said base and affixing said lever element and bar with said base in one of a plurality of vertical and horizontal adjusted positions.

2. A device as in claim 1 wherein said lever is configured to have a rectangular plate of hard material and said slot in said lever is disposed longitudinally in the middle of said bar.

3. A device as in claim 1 wherein the bar consists of two soft-cushion sleeves disposed at each end.

4. An apparatus as defined in claim 1 further characterized by;

said means constructed to slideably adjust said bar with respect to said base and affix said lever and said bar with said base in one of an infinite vertical and horizontal adjusted positions between respective upper and lower vertical limits and respective two horizontal limits.

* * * * *